US005324487A

United States Patent [19]

Sano et al.

[11] Patent Number: 5,324,487

[45] Date of Patent: * Jun. 28, 1994

[54] VACUUM-SUCTION DEGASSING APPARATUS

[75] Inventors: Masamichi Sano, Fujimori 1-43-3, Meito-ku, Nagoya-shi 465 Aichi-ken; Nobuo Miyagawa; Kunji Yamamoto, both of Tajiimi, all of Japan

[73] Assignees: Tokyo Yogyo Kabushiki Kaisha, Tokyo; Masamichi Sano, Nagoya, both of Japan

[ * ] Notice: The portion of the term of this patent subsequent to Apr. 26, 2011 has been disclaimed.

[21] Appl. No.: 58,663

[22] Filed: May 10, 1993

Related U.S. Application Data

[63] Continuation of Ser. No. 715,639, Jun. 14, 1991, abandoned.

[30] Foreign Application Priority Data

Jun. 16, 1990 [JP] Japan ..... 2-158320

[51] Int. Cl.[5] ..... C21C 7/00

[52] U.S. Cl. ..... 422/209; 75/407; 266/145; 266/149; 266/207; 266/208; 266/233; 266/235; 422/199; 422/211; 422/285

[58] Field of Search ..... 422/199, 211, 222, 231, 422/285, 288, 312, 209; 266/145, 149, 207, 208, 233, 235; 75/407; 55/189, 195, 196

[56] References Cited

U.S. PATENT DOCUMENTS

| | | | |
|---|---|---|---|
| 2,752,233 | 6/1956 | Peyches . | |
| 3,902,893 | 9/1975 | Ostberg et al. | 266/235 |
| 4,240,618 | 12/1980 | Ostberg | 266/235 |
| 4,257,810 | 3/1981 | Narumiya | 75/407 |
| 4,836,508 | 6/1989 | Fishler . | |
| 4,921,616 | 5/1990 | Minjolle | 75/407 |

FOREIGN PATENT DOCUMENTS

| | | | |
|---|---|---|---|
| 1032553 | 6/1958 | Fed. Rep. of Germany . | |
| 1051008 | 2/1959 | Fed. Rep. of Germany . | |
| 1926290 | 11/1970 | Fed. Rep. of Germany . | |
| 2158866 | 5/1973 | Fed. Rep. of Germany . | |
| 829777 | 3/1960 | United Kingdom | 266/208 |

OTHER PUBLICATIONS

European Search Report, Appln. No. 91109886.1, Masamichi Sano et al, Oct. 15, 1991.

*Primary Examiner*—Timothy M. McMahon
*Attorney, Agent, or Firm*—Oblon, Spivak, McClelland, Maier & Neustadt

[57] ABSTRACT

A melt is stored in a vessel. A lower half of a degassing member is immersed in the melt. The degassing member has a cylindrical form with the lower end closed, and the lower half section is made of a porous material which is permeable to gas and impermeable to melts as molten metal, molten slag, or molten matte. This lower half section is a partitioning member. When an internal space inside the degassing member is sucked to realize vacuum or reduced pressure atmosphere, gas producing components in the melt pass through the partition member of the degassing member, and are exhausted to inside the degassing member, thus being separated from the melt. Also, by making the degassing member rotate or move in a horizontal or vertical direction, the melt is stirred. With these features, gas-producing components in the melt can be removed at a high efficiency.

10 Claims, 4 Drawing Sheets

VACUUM-SUCTION DEGASSING APPARATUS

This application is a continuation of application Ser. No. 07/715,639, filed on Jun. 14, 1991, now abandoned.

BACKGROUND OF THE INVENTION

The present invention relates to a vacuum-suction degassing apparatus, in which gas-forming solute ingredients are removed or recovered from a melt, such as a molten metal, matte, or slag, through a porous member.

Conventionally, the RH method, DH method, and other degassing methods are used to remove gas-forming solute ingredients from a molten metal. According to the RH or DH method, a large quantity of argon gas is blown into the melt, the surface of which is kept at a vacuum or at reduced pressure so that the partial pressure of the gas-forming ingredients is lowered, thereby removing these ingredients.

Requiring the use of argon gas in large quantity, however, the conventional RH or DH degassing method entails high running cost. Since much argon gas is blown into the melt, moreover, the melt is liable to splash so that many metal drops adhere to the wall surface or some other parts of the apparatus, which requires troublesome removal work. To cope with this splashing of the melt, furthermore, the apparatus is inevitably increased in size, resulting in higher equipment cost.

SUMMARY OF THE INVENTION

The object of the present invention is to provide a vacuum-suction degassing apparatus, in which gas-forming ingredients can be easily removed from a melt without using a large quantity of argon gas, so that the melt can be degassed at low cost by means of a simple apparatus.

A vacuum-suction degassing apparatus according to the present invention, comprises a vessel containing a melt, a bottomed hollow partitioning member formed of a porous member permeable to gas and impermeable to melts, said partitioning member being immersed in said melt in said vessel, suction means for sucking gas from said melt or gas produced by a reaction at the interface between said melt and said porous member, in a manner such that the inside of said partitioning member is kept at a vacuum or at reduce pressure, and stirring means for stirring said melt by moving said partitioning member in said melt.

According to the present invention, the inside of the partitioning member is sucked by said sucking means, thereby the inside of the partitioning member being kept at a vacuum or at reduced pressure. Also, the melt is stirred by moving said partitioning member in said melt by said stirring means so that gas in the melt or gas produced by the reaction between the melt and the porous member can be moved to vacuum or reduced pressure space inside the partitioning member through said partitioning member made of a porous material with high efficiency. Also, the vacuum suction degassing apparatus according to this invention does not have to use argon gas, so that its running cost is low and also it is possible to suppress generation of splashes and reduce deposition of base metal onto a wall surface of the apparatus. Thus, according to the present invention, it is possible to reduce the equipment cost as well as its running cost.

DETAILED DESCRIPTION OF THE PREFERRED EMBODIMENTS

Figure 1:
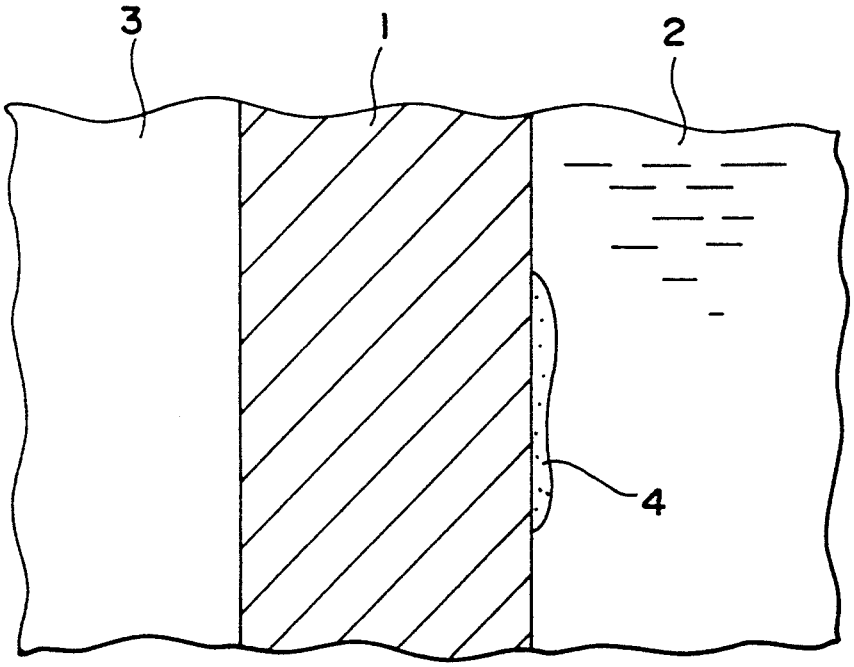
FIG. 1 is a diagram for illustrating the principle of the present invention.

First, description is made for a principle of this invention with reference to FIG. 1. Melt 2 is stored in a vessel (not shown). Partitioning member 1 is made of a porous material which is permeable to gas, but impermeable to melts, such as molten metal, molten matte, or molten slag, and is formed into a cylindrical form with a bottom. This partitioning member 1 performs such movements as rotation or vibration being driven by a drive device (not shown) and moves in the melt 2 to stir the melt 2.

In this case, if space 3 inside partitioning member 1 is kept at a vacuum or at reduced pressure 3, the pressure on the wall surface in contact with the melt drops without regard to the static pressure of the melt 2.

Accordingly, those impurities or valuables in melt 2 which produce gaseous substances easily nucleate on the wall surface of porous member I to form gas 4, and resulting gas 4 permeates through member I and sucked into space 3 at vacuum or reduced pressure atmosphere so that the impurities or valuables are removed from the melt and recovered into space 3 at vacuum or reduced pressure atmosphere.

The inventor hereof realized that gas-forming ingredients can be removed from the melt on the basis of the principle described above, and brought the present invention to completion.

The gas-forming ingredients dissolved in the melt are sucked and removed in the form of gases as follows:

$$\underline{N} + \underline{N} = N_2 \quad (1)$$

$$\underline{H} + \underline{H} = H_2 \quad (2)$$

$$\underline{C} + \underline{O} = CO \quad (3)$$

$$\underline{S} + 2\underline{O} = SO_2 \quad (4)$$

The impurities in the melt may react with the ingredients of the porous member, to form gases, and then they may be removed through the porous member.

If the porous member is an oxide ($M_XO_Y$), carbon in the melt is removed in the form of a gas as follows:

$$y\underline{C} + M_XO_Y(\text{solid}) = x\underline{M} + yCO \quad (5)$$

If the porous member contains carbon, moreover, oxygen in the melt is sucked and removed according to the following reaction formula.

$$\underline{O} + C(\text{solid}) = CO \quad (6)$$

The separative recovery of a valuable component (M) which has high vapor pressure is achieved by gasifying the valuable component according to the following reaction formulas.

$$x\underline{M} = M_x(gas) \quad (7)$$

$$MO_Y = MO_Y(gas) \quad (8)$$

$$MS_Y = MS_Y(gas) \quad (9)$$

In this manner, the impurities, such as N, H, C, O, and S, and the valuable components are sucked and removed or recovered from the melt.

When a rate of degassing reaction from a melt is very high, a speed of removal of components from the melt is restricted by a mass transfer of the gas-forming component in the melt. Therefore, in this invention, a melt is stirred by moving a partitioning member in said melt to promote mass transfer in the melt around the partitioning member made of a porous solid material.

Thus, in this invention, as a partitioning member stirs a melt by rotating or fluctuating in the melt, gas-producing components in the melt move to a surface of the partitioning member rapidly, or react with components of the partitioning member to generate gases as reaction products, and the gases are removed through the partitioning member from the melt. For this reason, this invention allow efficient separation of gas-producing components from melts.

Also, in this invention, by adjusting content of components of the partitioning member which react with the impurities or valuable components in a melt, it is possible to control a reaction rate between the impurities or valuable components in the melt and components of the partitioning member.

Note that a heating means may be added to heat a partitioning member or a melt by energizing the partitioning member or burying a resistance wire previously in the partitioning member and energizing the resistance wire, or by heating the melt from outside (by means of, for instance, plasma heating), for the purpose to prevent the decrease of temperature of the melt due to heat emission to atmosphere or the vessel or the decrease of temperature of the melt which occurs when the partitioning member is immersed into the melt, or decrease of temperature of the melt due to an endothermic reaction between components of the partitioning member and the melt.

Various materials may be used for porous member, including metallic oxides or other metallic compounds (non-oxides), carbon and mixtures thereof and metal, such as $Al_2O_3$, MgO, CaO, $SiO_2$, $Fe_2O_3$, $Fe_3O_4$, $Cr_2O_3$, BN, $Si_3N_4$, SiC, C, etc. Preferably, the material used should not react with the principal ingredient of melt 2 so that porous member in contact with melt 2 can be prevented from erosion loss and melt 2 can be kept clean.

Also, a material which hardly gets wet with melts must be used for the partitioning member so that only gases can pass through the partitioning member but any melt can not pass through the partitioning member. Furthermore, it is preferable that a porosity of the partitioning member is not more than 40%.

Furthermore, in order to prevent a melt from entering the vacuum system even if a melt goes into the immersed porous tube, it is preferable to allocate a filter with small pressure loss in an upper section of the immersed porous tube to solidify the invading melt for trapping it.

The following is a description of a case in which the present invention is applied to the removal or recovery of gas-forming ingredients from a melt.

(1) First, the present invention can be applied to decarburization, denitrogenation, and dehydrogenation processes for removing carbon, nitrogen, or hydrogen from molten iron.

When this method is applied to remove carbon from molten iron, the main component of said partitioning member should be $Al_2O_3$ or MgO, and such a material as $Fe_2O_3$, $Fe_3O_4$, MnO, and $SiO_2$ should be mixed in as main oxidizing agents for carbon in the molten iron. But if a compounding ratio of the main oxidizing agent is too high, a melting point of the partitioning member goes down, or the mechanical strength thereof becomes lower, and if carbon content in the molten iron is too low, oxygen content in the molten iron goes up, so that a compounding ratio of the main oxidizing agent must be decided according to the purpose and by referring to the phase diagram already established.

On the other hand, if this method is applied to removal of nitrogen in molten iron, a stable oxide such as CaO, $Al_2O_3$, or MgO should be used as said partitioning member.

Also, if this invention is applied to simultaneous removal of carbon and nitrogen in molten iron, the compounding ratio of the oxidizing agent should be changed according to target contents of carbon and nitrogen in the molten iron.

(2) The invention can be also applied to a deoxygenation process for removing oxygen from molten copper.

(3) Further, the invention can be applied to a dehydrogenation process for removing hydrogen from molten aluminum.

(4) Furthermore, the invention can be applied to decarburization, and dehydrogenation of molten silicon.

(5) According to the present invention, zinc can be recovered from molten lead.

(6) The invention can be also applied to a desulfurization/deoxygenation process for removing sulfur and oxygen from molten copper matte.

(7) Further, the invention can be applied to the recovery of valuable metals (As, Sb, Bi, Se, Te, Pb, Cd, etc.) from molten copper matte or nickel matte.

(8) Furthermore, the invention can be applied to the recovery of valuable metals (As, Sb, Bi, Se, Te, Pb, Cd, Zn, etc.) from slag.

Detailed description is made below for embodiments of this invention.

Figure 2:
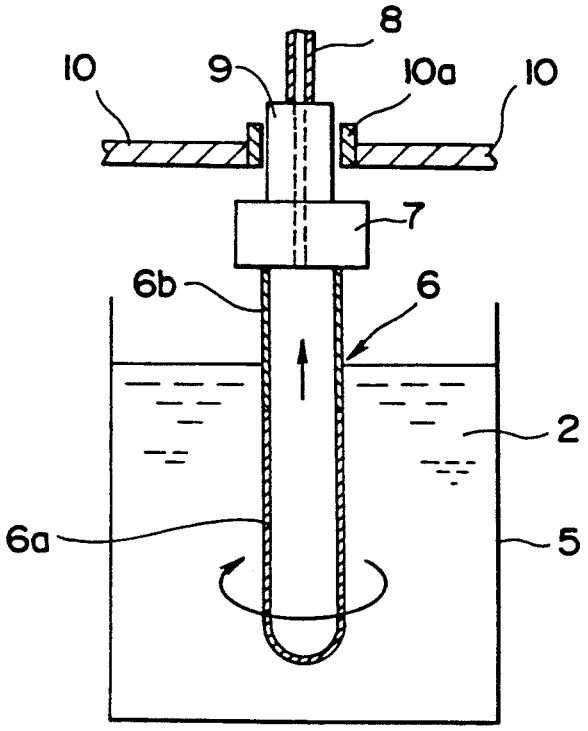
FIG. 2 is a schematic cross-sectional view showing a first embodiment of the invention.

FIG. 2 is a schematic cross-sectional view showing a first embodiment of the present invention. Melt 2 is stored in vessel 5, and a lower half section of degassing member 6 is immersed in melt 2. Degassing member 6 has a cylindrical form with the lower end closed, and the lower half portion immersed into melt 2 is made of a porous material having fine pores which is permeable to gas but impermeable to melts such as molten metal, molten slag, or molten matte, thus preventing the melt from permeating it. This lower half portion of degassing member 6 made of a porous material is partitioning member **6*a*. An upper half portion of degassing member 6 is made of a non-porous material which does now allow permeation of gases. Partitioning member 6*a* and non-porous member 6*b* may be made separately and then joined together, or the entire degassing member 6 may be made with a porous material first and then the upper half portion may be coated with a non-porous material which does not allow permeation of gases to obtain non-porous member 6b**, thereby preventing gases from passing through this section.

On a top end of non-porous member 6b which is exposed in atmosphere and does not allow permeation of gases are fixed linking member 7 and supporting shaft 9. And, to a top end of this supporting shaft 9 is linked piping 8 linked to a vacuum suction pump (not shown) via supporting shaft 9 and linking member 7 so that piping 8 communicates with an internal space of degassing member 6.

This supporting shaft 9 is supported by plate 10 with a bearing 10a arranged on it. Also, degassing member 6 rotates around a central axis of supporting shaft 9 being driven by a driving section (not shown).

In the vacuum suction degassing apparatus thus constructed, degassing member 6 is rotated and gases inside degassing member 6 is sucked via piping 8 to create vacuum or a reduced pressure atmospheric state inside degassing member 6. Then, melt 2 is stirred by rotation of the degassing member 6, gas components in melt 2 pass through the partitioning member 6a of degassing member 6 and are exhausted to inside degassing member 6, thus being separated from melt 2. In this embodiment, the melt can be degassed with an extremely high efficiency.

Figure 3:
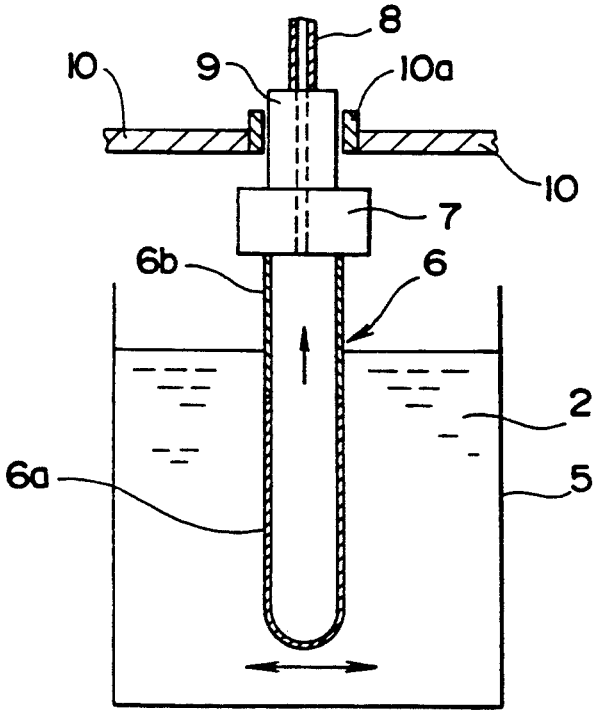
FIGS. 3 to 5 are schematic cross-sectional views showing second to fourth embodiments of the invention, respectively.
Figure 4:
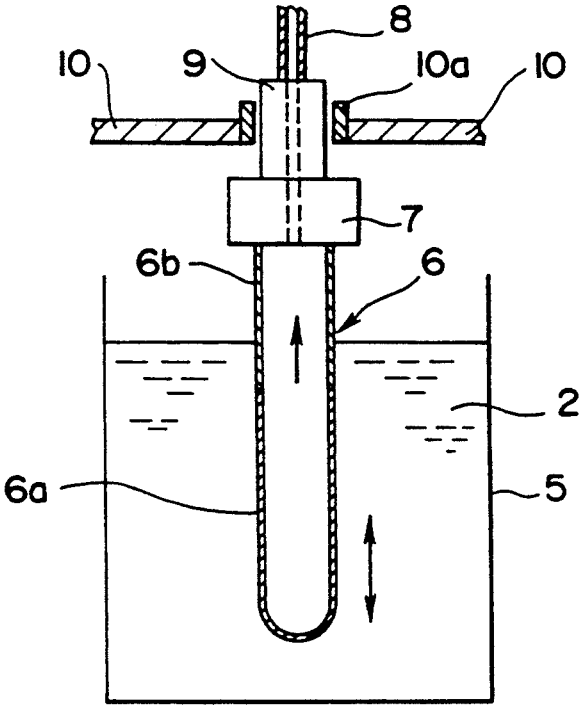
Figure 5:
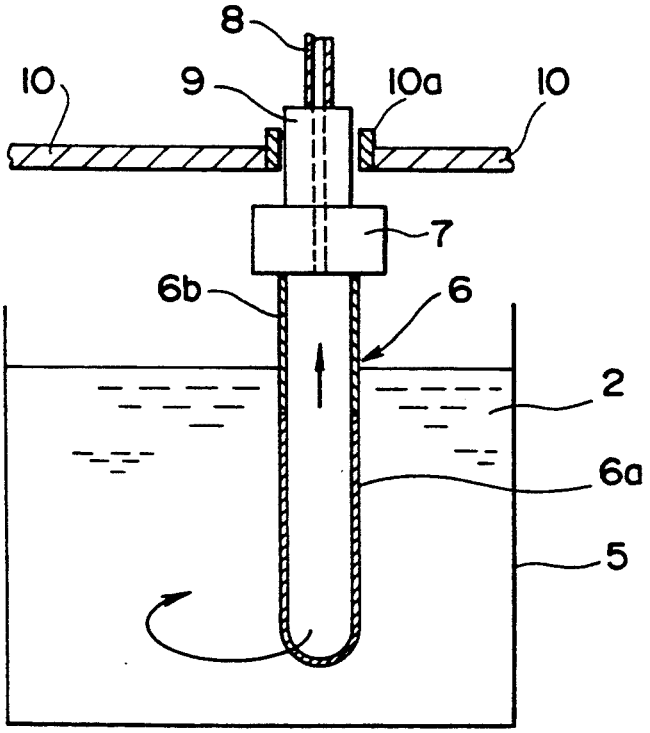

FIG. 3 to FIG. 5 are simplified cross-sectional views showing vacuum suction degassing apparatus according to second to fourth embodiments of this invention, respectively.

The difference of these embodiment from the first embodiment is that directions of movement of the degassing member 6 are different.

In the vacuum suction degassing apparatus according to the second embodiment of this invention showing in FIG. 3, degassing member 6 makes a reciprocal movement along a direction crossing the longitudinal direction thereof at right angles.

On the other hand, in the vacuum suction degassing apparatus according to the third embodiment of this invention shown in FIG. 4, degassing member 6 makes a vertical reciprocal movement along the longitudinal direction thereof.

Furthermore, in the vacuum suction degassing apparatus according to the fourth embodiment of this invention shown in FIG. 5, the degassing member 6 rotates around a shaft which is in parallel to the central axis thereof.

Also, in any of the apparatuses according to the second to fourth embodiments of this invention, melt 2 is stirred by degassing member 6, and degasification of melt 2 can be performed with an extremely high efficiency.

Note that directions of movement of degassing member 6 are not limited to those described above and 2 or more movement directions shown in FIGS. 2 to 5 may be combined.

The following is a description of results of decarburization of molten iron. This decarburization test was conducted by using the apparatus shown in FIG. 2. First, 400 g of electrolytic iron was melted by means of a high-frequency induction furnace, and was loaded into an alumina crucible (inside diameter: 46 mm). Then, a porous alumina pipe ($Al_2O_3$:93%, $SiO_2$: 6.5%, $Fe_2O_3$:0.5%, outside diameter: 14 mm, inside diameter 6 mm, porosity: 25%) was immersed to a depth of 40 mm in molten iron 46 mm deep in the crucible. The internal pressure of this porous pipe was reduced to 2 torr.

Thereafter, carbon was added to the molten iron so that the carbon concentration of the molten iron was 100 ppm. As a result, the carbon concentration of the molten iron was lowered from 100 ppm to 10 ppm in 20 minutes after the addition of carbon. In the meantime, the oxygen concentration was kept constant at about 50 ppm. It is evident, therefore, that the degassing advances as carbon reacts with alumina and the like in the material of the porous pipe according to the following reaction formulas.

$$3\underline{C} + Al_2O_3 = 2\underline{Al} + 3CO,$$

$$2\underline{C} + SiO_2 = \underline{Si} + 2CO,$$

$$3\underline{C} + Fe_2O_3 = 2Fe + 3CO.$$

In this manner, CO gas is removed from the molten iron, while Al and Si are added to the molten iron.

Figure 6:
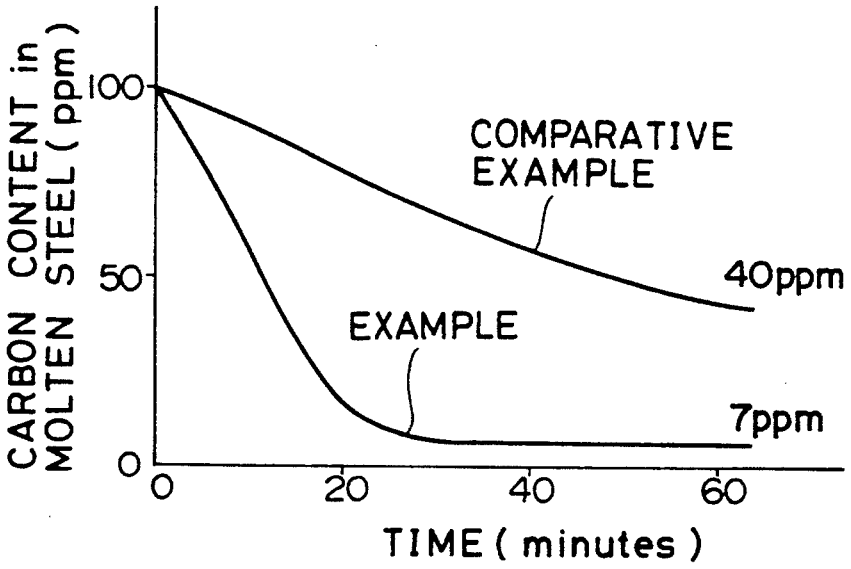
FIG. 6 is a graph showing effects of the invention.

The following is a description of the decarburization efficiency for the aforementioned embodiment in which the internally decompressed porous alumina pipe was immersed, compared with that for a comparative example in which no porous pipe was used. FIG. 6 is a graph comparatively showing the efficiencies for the respective cases of the embodiment using the porous pipe and the comparative example using non-porous pipe. In FIG. 6, the axes of abscissa and ordinate represent the time and the carbon concentration of the molten iron. As seen from FIG. 6, the carbon concentration lowered to 7 ppm in about 25 minutes of vacuum suction degassing with use of the porous pipe, while the concentration lowered only to 40 ppm even after one hour of degassing without the use of the porous pipe. Thus, the present invention can be very effectively applied to the removal or recovery of gas-forming solute ingredients from melts.

We claim:

1. A vacuum-suction degassing apparatus comprising:

a vessel containing a melt of molten metal, matte or slag;

a hollow partitioning member having a bottom formed of a porous member material permeable to gas and impermeable to melt, said porous material having a chemical composition which chemically reacts with an impurity in said melt to yield a product gas, said partitioning member being immersed in said melt;

suction means connected to said partitioning member for sucking gas from said melt or said product gas, keeping the inside of said partitioning member at a pressure less than atmospheric pressure so that suction permeation of said gas from melt or said product gas through said porous member is effected and, means for placing said partitioning member in motion within said melt to effect stirring.

2. The vacuum-suction degassing apparatus according to claim 1, comprising heating means for electrically heating said partitioning member.

3. The vacuum-suction degassing apparatus according to claim 1, wherein said stirring means has a driving unit connected to said cylindrical partitioning member around an axis which rotates said cylindrical partitioning.

4. The vacuum-suction degassing apparatus according to claim 1, wherein said stirring means has a driving unit to make said hollow partitioning member do reciprocal movement in the horizontal direction.

5. The vacuum-suction degassing apparatus according to claim 1, wherein said stirring means has a driving unit to make said hollow partitioning member do reciprocal movement in the vertical direction.

6. The vacuum-suction degassing apparatus according to claim 1, wherein said stirring means has a driving unit to make said hollow partitioning member rotate around an axis in parallel with a shaft.

7. The vacuum-suction degassing apparatus of claim 1, wherein said porous membrane has a porosity of between 25 and 40%.

8. The vacuum-suction degassing apparatus according to claim 1, wherein said porous material is a material selected from the group consisting of:

$Al_2O_3$, MgO, CaO, $SiO_2$, $Fe_2O_3$, $Fe_3O_4$, $Cr_2O_3$, BN, $Si_3N_4$, SiC and C.

9. A vacuum-suction degassing apparatus according to claim 1, wherein said porous material is an oxide having the formula $M_XO_Y$ and the impurity is carbon, said impurity being removed according to the formula:

$$y\underline{C}+M_XO_Y(\text{solid})=x\underline{M}+yCO.$$

10. The vacuum-suction degassing apparatus according to claim 1, wherein said porous member contains carbon, wherein said impurity is oxygen, and said impurity is removed according to the formula:

$$\underline{O}+C(\text{solid})=CO.$$

* * * * *